US010584023B2

(12) United States Patent
Beyda et al.

(10) Patent No.: US 10,584,023 B2
(45) Date of Patent: Mar. 10, 2020

(54) MULTI RESERVOIR DISPENSER

(71) Applicant: TOWN & COUNTRY LINEN CORP., New York, NY (US)

(72) Inventors: Jeffrey Beyda, New York, NY (US); Lou Henry, New York, NY (US); Chris Mellen, New York, NY (US); Jennifer Roy, New York, NY (US); Robert Passaretti, New York, NY (US); Gina Barnaba, New York, NY (US)

(73) Assignee: TOWN & COUNTRY LINEN CORP., New York, NY (US)

( * ) Notice: Subject to any disclaimer, the term of this patent is extended or adjusted under 35 U.S.C. 154(b) by 0 days.

(21) Appl. No.: 16/023,224

(22) Filed: Jun. 29, 2018

(65) Prior Publication Data

US 2020/0002152 A1 Jan. 2, 2020

(51) Int. Cl.
*B67D 3/00* (2006.01)

(52) U.S. Cl.
CPC ..... *B67D 3/0064* (2013.01); *B67D 3/0019* (2013.01)

(58) Field of Classification Search
CPC ..... B05B 11/0078; B05B 11/3045; B05B 11/3057; B67D 3/0019; B67D 3/0064
USPC ..... 222/130, 135, 144.5, 182, 266, 321.6, 222/372, 378, 383.1
See application file for complete search history.

(56) References Cited

U.S. PATENT DOCUMENTS 4,006,841 A * 2/1977 Alticosalian ..... B65D 83/205 222/135
4,549,674 A * 10/1985 Alticosalian ..... B65D 83/205 222/135
5,152,431 A * 10/1992 Gardner ..... B05B 11/3081 222/136
5,152,461 A * 10/1992 Proctor ..... B05B 11/0064 239/304
5,752,626 A * 5/1998 Bachand ..... B05B 1/3436 222/136
5,833,121 A * 11/1998 Gueret ..... B05B 11/0029 222/144.5
6,869,027 B2 * 3/2005 Foster ..... B05B 11/3009 222/383.1
7,222,752 B2 * 5/2007 Ponton ..... B05B 11/3083 222/134

(Continued)

*Primary Examiner* — Vishal Pancholi
(74) *Attorney, Agent, or Firm* — Leason Ellis LLP

(57) ABSTRACT

A multi reservoir dispenser includes a first reservoir for holding a first fluid and a second reservoir for holding a second fluid. The dispenser further includes first pump mechanism that includes a first displaceable plunger and a first plunger cavity that is disposed along a first flow path for receiving the first fluid and a second displaceable plunger and a second plunger cavity for receiving the second fluid. An actuator includes a selector and an actuator that are movable between: (a) a first position in which only the first plunger of the pump mechanism is actuated for discharging only the first fluid through a first orifice of a fluid dispensing manifold by causing the first fluid to flow along a first flow path; and (b) a second position in which only the second plunger of the pump mechanism is actuated for discharging only the second fluid through a second orifice of the fluid dispensing manifold by causing the second fluid to flow along a second flow path.

26 Claims, 15 Drawing Sheets

(56) References Cited

U.S. PATENT DOCUMENTS

| | | | | |
|---|---|---|---|---|
| 7,240,808 | B2 * | 7/2007 | Brugger | B05B 11/3083 222/135 |
| 8,800,818 | B2 * | 8/2014 | Greenberg | B05B 11/3059 222/135 |
| 2004/0238567 | A1 * | 12/2004 | Bloc | B05B 11/3084 222/135 |
| 2010/0044394 | A1 * | 2/2010 | Milian | B05B 11/3007 222/135 |
| 2018/0056312 | A1 * | 3/2018 | Hou | A45D 34/06 |

* cited by examiner

MULTI RESERVOIR DISPENSER

TECHNICAL FIELD

The present invention relates to dispensers that are configured to dispense a fluid and more particularly, to a dispenser, such as a hand pump, that has multiple reservoirs with each reservoir having an independent, distinct flow path to a dispenser head orifice through which the fluid is expelled.

BACKGROUND

Dispensers find numerous uses both domestically and industrially for dispensing a variety of fluids. There are many different types of dispensers with one of the more popular liquid dispensers being a spray bottle. Spray bottles dispense a variety of fluids from plain liquids, such as water, alcohol, to complex liquid-based compounds. Cleaning products, such as kitchen and bathroom cleaning products, are often dispensed through spray bottles.

Traditional spray bottles and hand pump dispensers contain a single reservoir that holds a single fluid and include a spray bottle head that is actuated to dispense the fluid. The spray bottle head is typically made up of only a few parts including a trigger lever which activates a small pump. This pump is attached to a plastic tube that draws the fluid from the bottom of the reservoir (which can be in the form of a plastic bottle). The pump forces the liquid down a narrow barrel and out of a small hole formed in a nozzle piece, which is often adjustable to change the flow characteristics of the fluid. The fluid pump has a simple design in that the main moving element is a piston that is housed within a cylinder. Inside of this cylinder is a small spring. To operate the pump, the user pulls back the trigger which results in the piston being pushed into the cylinder. The moving piston compresses the spring so that when the user releases the trigger, the piston is pushed back out of the cylinder. These two strokes of the piston constitute the entire pump cycle.

The downstroke of the piston when the piston is pushed into the cylinder reduces the area of the cylinder and therefore, forces fluid out of the pump. Conversely, during the upstroke of the piston, the area within the cylinder is expanded and fluid is drawn into the cylinder. In order to accomplish the aforementioned actions, the spray bottle includes at least one one-way valve. The spray bottle can have two one-way valves in the pumping system, namely, a first one-way valve that is located between the pump and the reservoir and a second one-way valve that is located between the pump and the nozzle. Often, the one-way valve between the pump and the reservoir is in the form of a small rubber ball (or metal or plastic) that rests neatly inside a small seal. When no pumping action is occurring, the ball seats against the seal and the fluid passageway is blocked. During a pumping action when the user releases the trigger, the expanding area of the cylinder sucks the fluid below resulting in the ball being pulled out of the seal. Since the ball is not seated against the seal, the fluid is free to flow from the reservoir. However, when the trigger is squeezed, the dispensing force of expelling the fluid pushes the ball into the seat blocking off the passageway to the reservoir and as a result, the pressurized fluid is pushed only into the barrel.

Hand pumps are often very common and are similar to spray bottles in that a hand pump holds a fluid (e.g., liquid) that is dispensed by action of a pump mechanism. In particular, the dispenser's pump is attached to a tube which runs into a storage chamber where the fluid is contained. When the pump is activated manually by applying pressure to the pump mechanism, this first pushes air out of the tube to create a suction effect, Which then draws the fluid back up the tube, releasing it via the pump spigot for fast, efficient cleaning and hand washing. Foaming dispensers, however, function a little differently. Comprised of two main chambers (rather than one), foaming dispensers combine and mix the air from one chamber with the liquid (e.g., housed) housed in another in order to dispense a pre-measured amount of the thick (soapy) lather.

Hand pumps are often used to dispense personal health care products, such as shampoos, conditioners, body washes, hand soap, etc. However, there are other applications for hand pumps including car care products and also cooking supplies and food condiments, such as dressings and oils, food condiments, etc.

In addition, other types of personal care products, such as tanning supplies including but not limited to an aloe vera solution (gel), tanning oil, suntan lotion, etc. It will thus be appreciated that other types of fluids can be used in a hand pump dispenser and the foregoing applications and fluids are not limiting of the present invention.

There is therefore, a need for a multi-reservoir dispenser, such as a pump dispenser, that has completely separate plumbing for each fluid to be dispensed along the entire flow path from the reservoir to the nozzle.

SUMMARY

A multi reservoir dispenser, such as a hand pump dispenser, includes, according to one exemplary embodiment, a main receptacle having a first reservoir for holding a first fluid and a second reservoir for holding a second fluid. Alternatively, discrete individual receptacles can be used as opposed to partitioning one main receptacle into discrete reservoirs. A first pump mechanism is in fluid communication with the first reservoir via a first flow path and the first pump mechanism has a first displaceable plunger. A second pump mechanism is in fluid communication with the second reservoir via a second flow path and the second pump mechanism has a second displaceable plunger. A closure serves to cover the main receptacle and has a dispensing opening formed therein.

A fluid dispensing manifold is provided and has a first orifice in fluid communication with the first flow path and a second orifice in fluid communication with the second flow path. The manifold is disposed within the dispensing opening.

An actuator assembly is provided and includes a selector and actuator that is fixedly attached to the selector. The actuator assembly is movable between: (a) a first position in which only the first displaceable plunger of the first pump mechanism is actuated by the actuator for discharging only the first fluid through the first orifice of the manifold by causing the first fluid to flow along the first flow path; and (b) a second position in which only the second displaceable plunger of the second pump mechanism is actuated by the actuator for discharging only the second fluid through the second orifice of the manifold by causing the second fluid to flow along the second flow path. The actuator assembly is both rotatable and displaceable in an axial direction.

In accordance with the present invention, the first flow path and the second flow path are fluidly isolated from one another along an entire length from the first reservoir to the first orifice and from the second reservoir to the second orifice, respectively. In this way, cross-contamination between the two fluids is prevented.

BRIEF DESCRIPTION OF THE DRAWING FIGURES

DETAILED DESCRIPTION OF CERTAIN EMBODIMENTS

Figure 1:
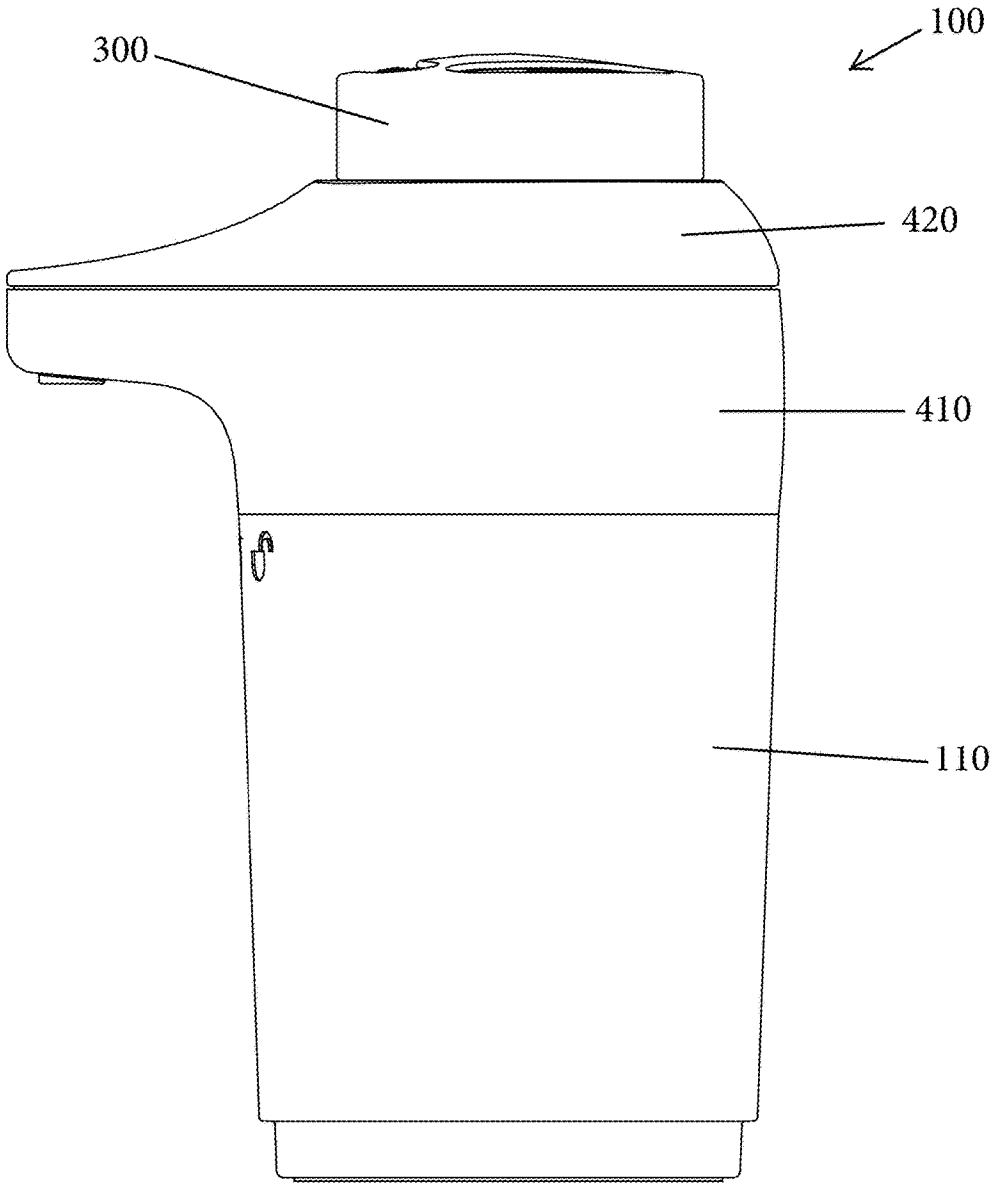
FIG. 1 is a side elevation view of a multi-reservoir dispenser (e.g., hand pump dispenser) in accordance with one embodiment of the present invention.

FIGS. 1-15 illustrate a multi-reservoir dispenser 100 in accordance with one embodiment of the present invention. The illustrated dispenser 100 can be in the form of a hand pump that includes a plurality of discrete individual reservoirs. For example, the dispenser 100 is configured to include two or more reservoirs and in the illustrated embodiment, the dispenser 100 includes three reservoirs, namely, a first reservoir 10, a second reservoir 20, and a third reservoir 30. Each of the first reservoir 10, second reservoir 20, and third reservoir 30 is defined in a main receptacle 110 which can be in the form of a bottle or cup that is open at one end and closed at the other end. A divider 40 can be inserted into or formed as an integral part of the hollow interior of the main receptacle 110 to create the three discrete reservoirs 10, 20, 30. As shown, the divider 40 has three spokes formed 120 degrees apart from one another so as to define the three reservoirs 10, 20, 30 that have the same volume. It will be appreciated that in other embodiments, the areas (volumes) of the three reservoirs 10, 20, 30 can be different from one another in that one of the reservoirs can have a volume that is greater or less than the volume of the other reservoirs. In this manner, a greater amount of one fluid can be supplied in one respective reservoir compared to the other reservoirs. As shown, the three spokes meet at a common center point (a hub) that is centrally located within the main receptacle 110.

The main receptacle 110 can be formed in any number of different shapes and sizes with the illustrated main receptacle 110 being in the form of a cylinder.

Figure 5:
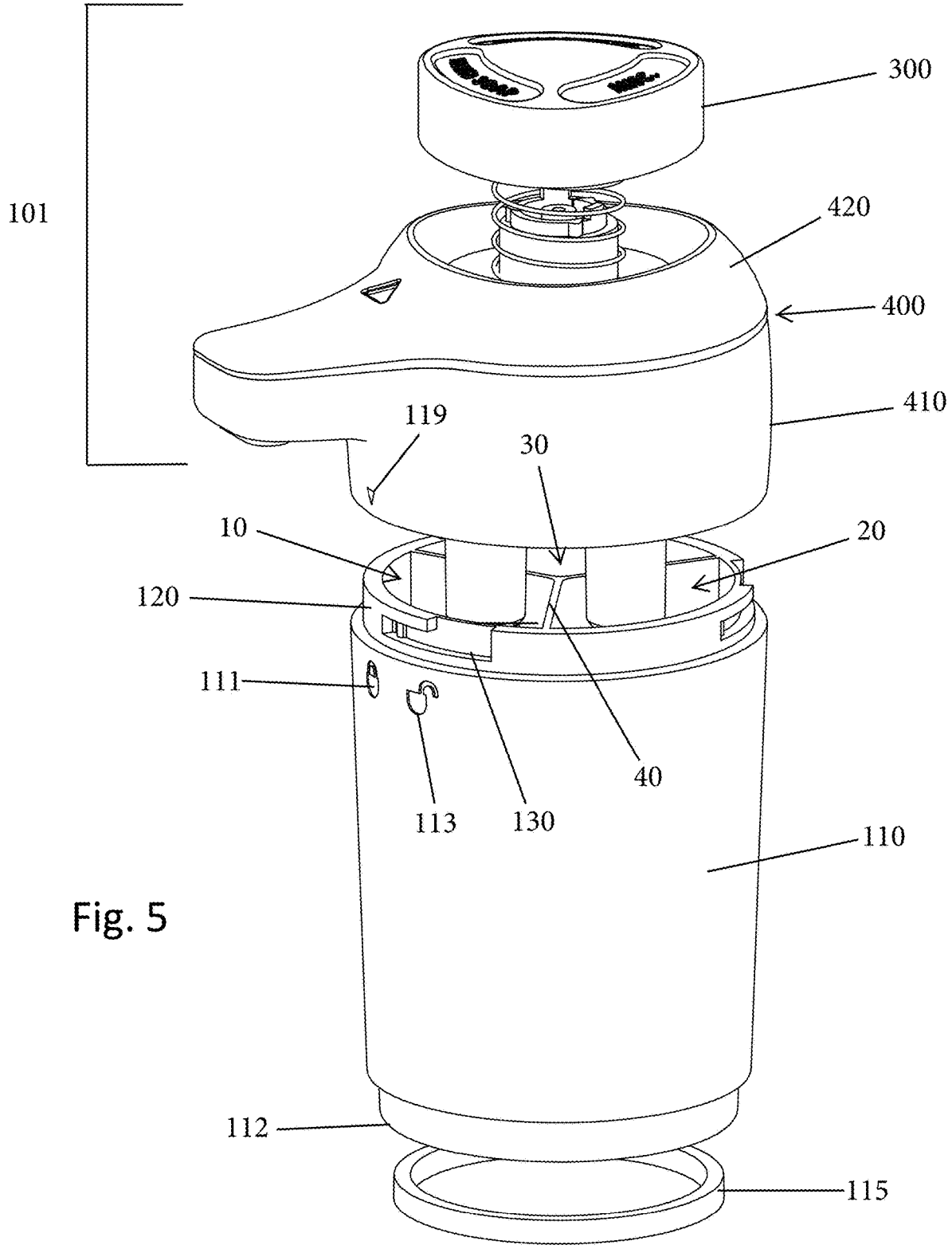
FIG. 5 is an exploded side perspective view thereof.
Figure 6:
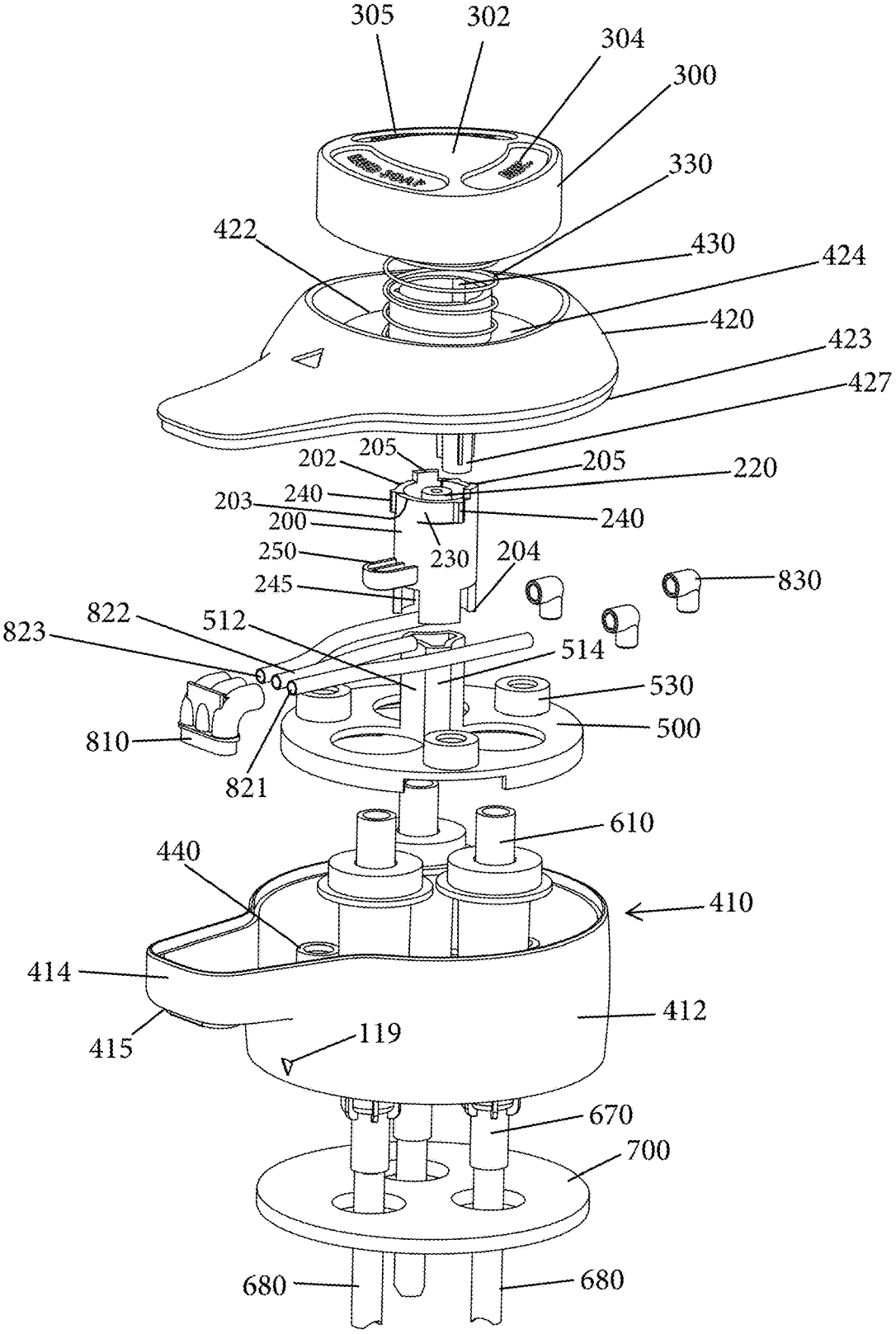
FIG. 6 is an exploded side perspective view of internal components of the pump mechanism and related manifold that includes discrete plural flow paths.
Figure 7:
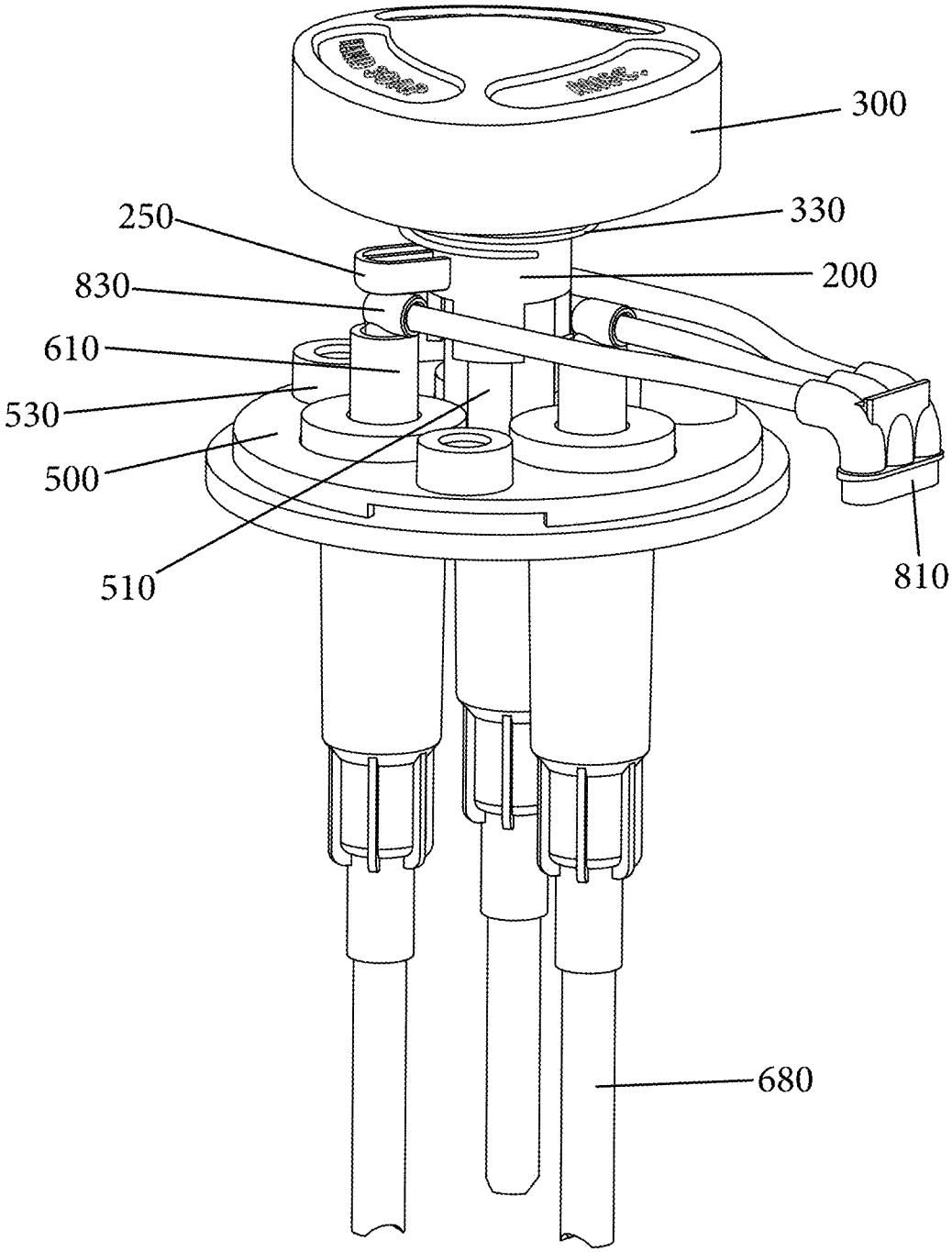
FIG. 7 is a side perspective view of internal components in an assembled condition.
Figure 8:
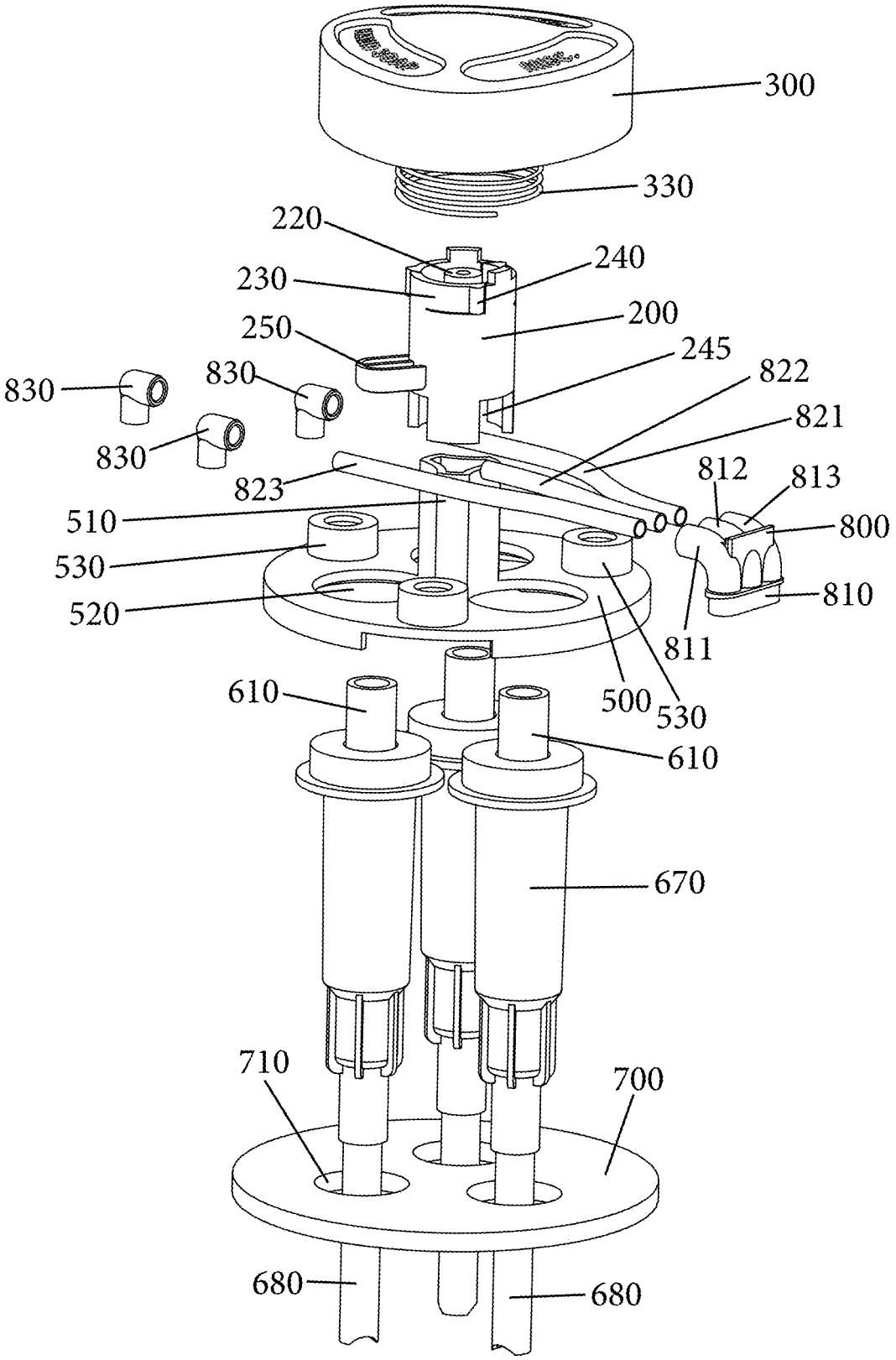
FIG. 8 is an exploded side perspective view of the internal components of FIG. 7.
Figure 10B:
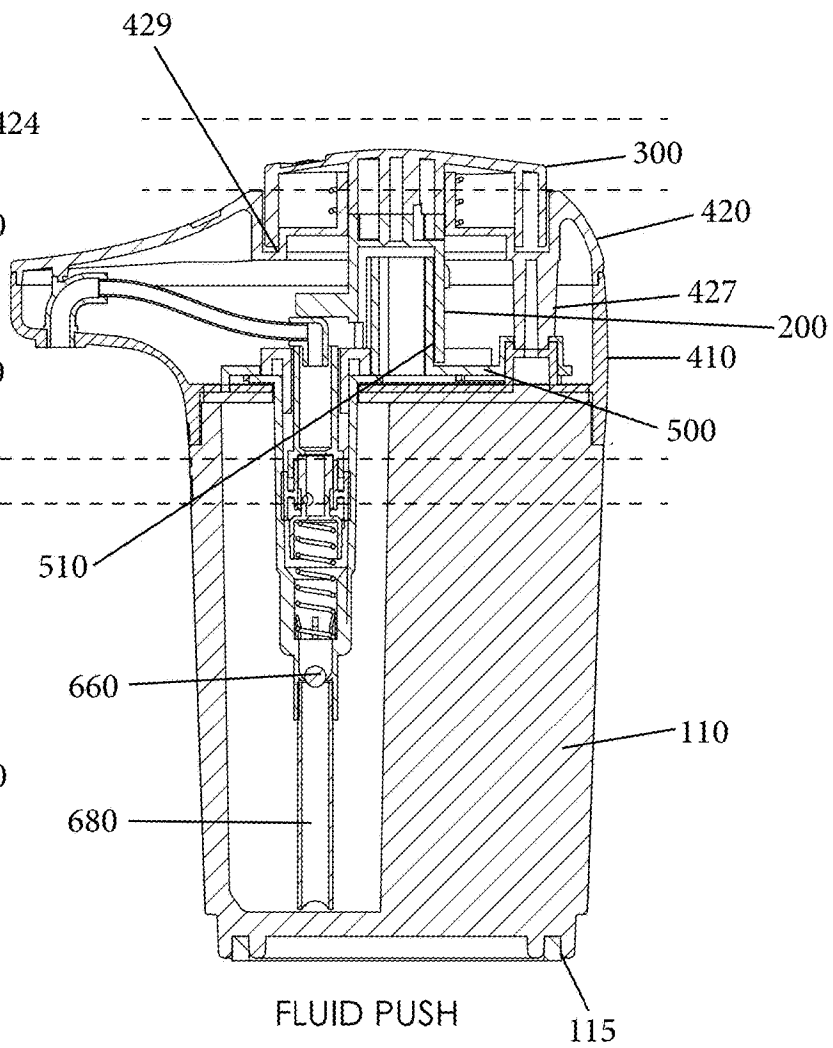
FIGS. 10A and 10B are cross-sectional view of the pump assembly showing a spraying action with FIG. 10A showing a fluid pull position and FIG. 10B showing a fluid push position.
Figure 10A:
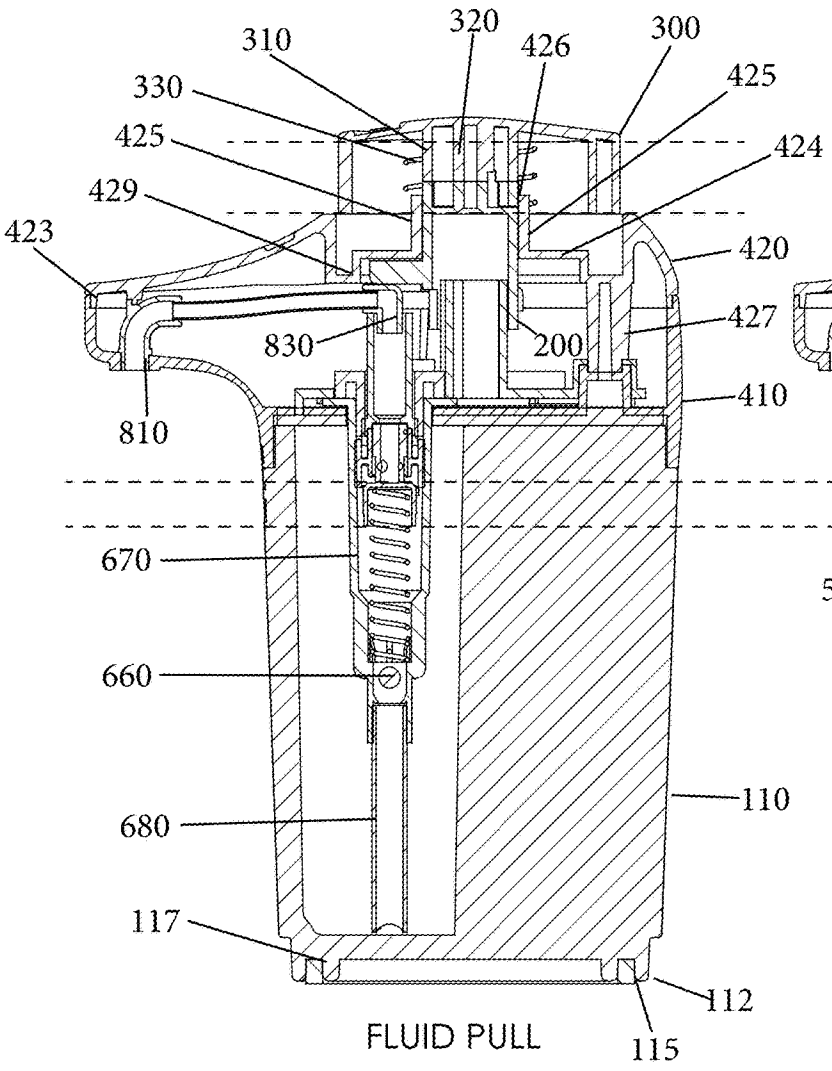

As best shown in FIGS. 5 and 10A and 10B, a closed end 112 of the main receptacle 110 can include an elastic foot 115, such as a rubber foot 115. Along a bottom surface of the closed end 112, a channel or groove 117, such as an annular shaped channel, is formed and the elastic foot 115 can be in the form of circular shaped piece of rubber that includes a protrusion 119 that is constructed so as to complement groove 117 and more particularly, the protrusion 119 is received within the groove 117 so as to couple the elastic foot 115 to the main receptacle 110. The elastic foot 115 can provide a grip surface to a bottom of the main receptacle 110.

Figure 2:
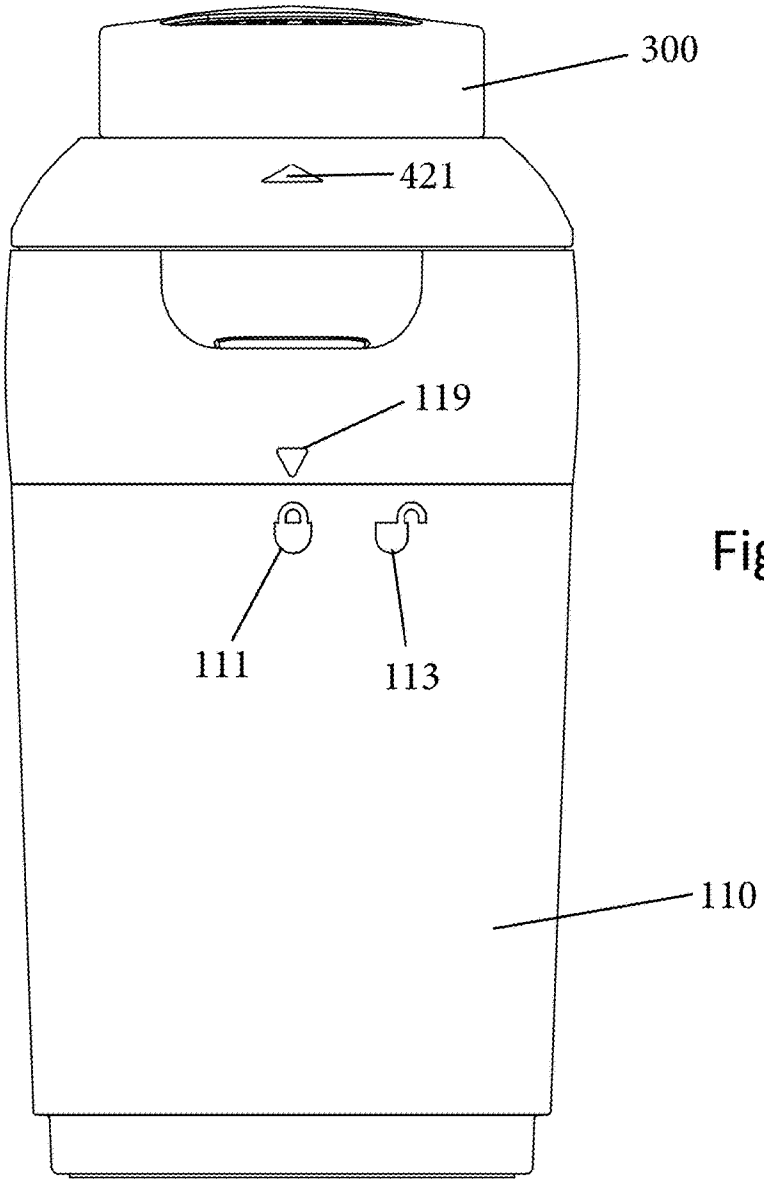
FIG. 2 is a front elevation view thereof.
Figure 3:
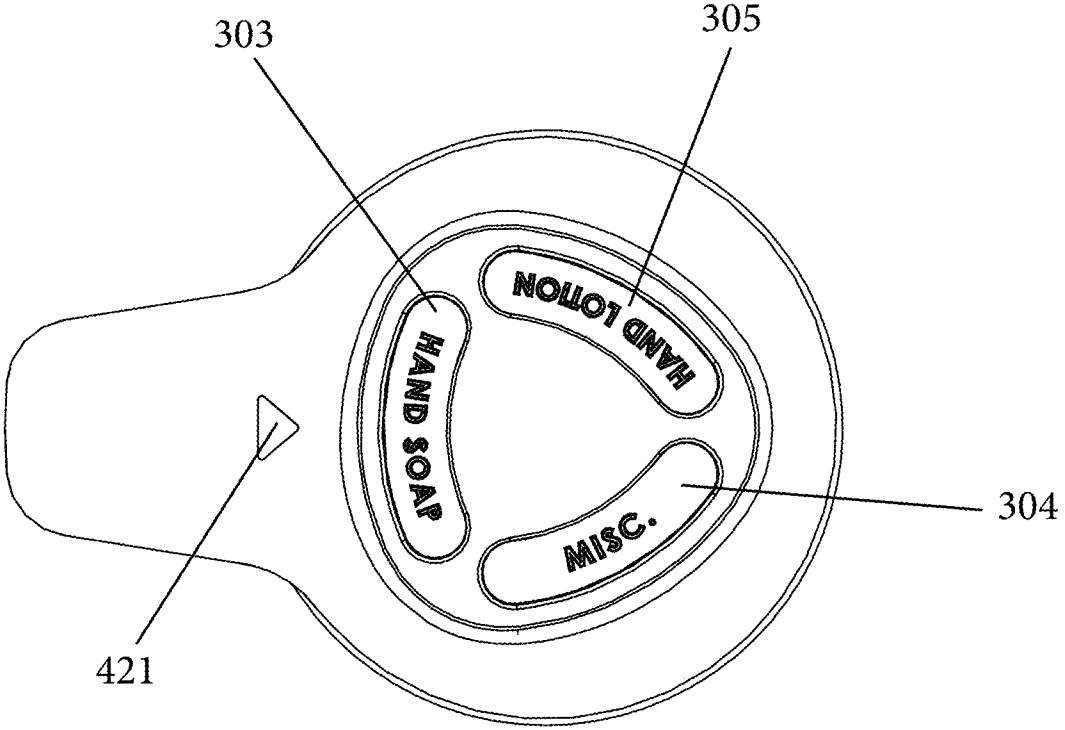
FIG. 3 is a top plan view thereof.

As described herein, the main receptacle 110 can be locked in place with respect to a top cover (closure as described below) and as shown in FIG. 2, the main receptacle 110 includes locked indicia 111 and unlocked indicia 113 which guides the user in positioning the main receptacle 110 in either the locked position or the unlocked position. For example, the locked indicia 111 can be in the form of a graphic of a locked padlock, while the unlocked indicia 113 can be in the form of a graphic of an unlocked padlock.

In the illustrated embodiment, the multi-reservoir construction has a generally cylindrical shape and therefore, each of the reservoirs 10, 20, 30 is generally wedge shaped and the three reservoirs 10, 20, 30 fit together so as to define a cylindrical shape. With three reservoirs of equal volume, the reservoirs generally extend 120 degrees.

It will also be understood that only two reservoirs can be provided in which case each reservoir would extend 180 degrees and further, more than three reservoirs can be provided. In the event that four reservoirs are provided, each reservoir extends 90 degrees. While, the illustrated embodiment shows a cylindrically shaped complete reservoir assembly, it will be appreciated that the complete reservoir assembly can take other forms and shapes and is not limited to a cylindrically shaped reservoir assembly.

As shown in the figures, the dispenser 100 includes an actuator 200, a selector 300, and a closure 400 that serves to cover and close off the open end of the main receptacle 110. Broadly speaking, the combination of the selector 300 and the actuator 200 is often referred to as being a pump head, and is what the consumer presses down to pump the product out of the main receptacle 110 and the closure 400 can be thought of as being a component that attached the entire head assembly onto the open top end of the main receptacle 110. As discussed herein, the selector 300 comprises the component that allows the user to select which of the three reservoirs 10, 20, 30 is actuated for dispensing fluid therefrom. The actuator 200, selector 300 and closure 400 form a head assembly 101 that can be detachably attached to the top end of the main receptacle 110. This head assembly 101 is thus the portion of the dispenser 100 that is lockingly, yet detachably, mated to the main receptacle 110 for covering the open end of the main receptacle 110 and also positioning the pump mechanism, that is described herein, within the respective reservoirs 10, 20, 30.

Figure 12:
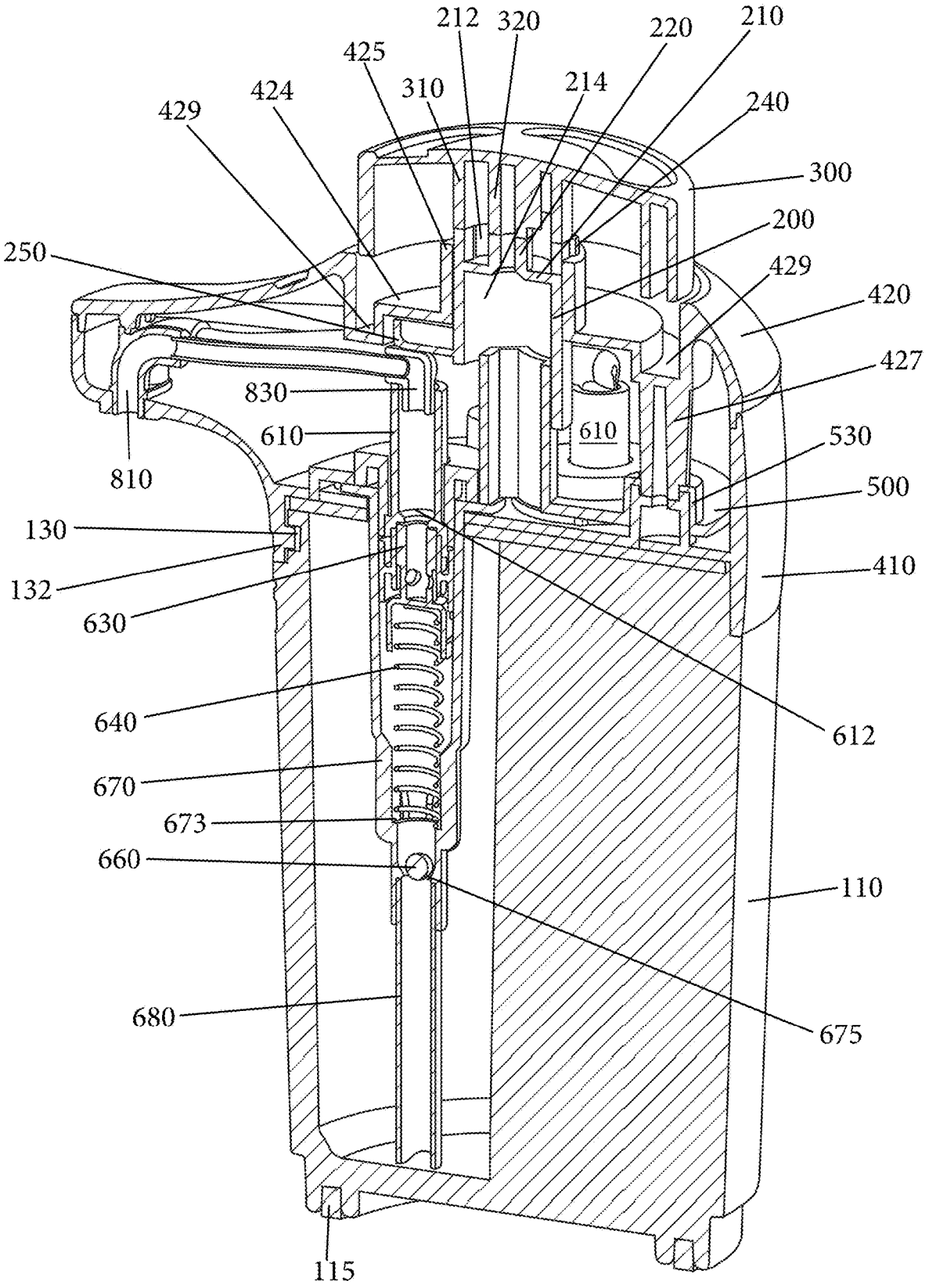
FIG. 12 is a perspective view, in cross-section, of the dispenser.

Any number of different types of connections can be used to detachably attach the head assembly 101 to the main receptacle 110. For example, a bayonet type mount can be used. As shown in FIG. 5, the open top end of the main receptacle 110 includes an annular shaped flange 120 that has a diameter less than the lower portion of the main receptacle 110 so as to form a shoulder (a right angle shoulder). Within the flange 120, one or more slots 130 are formed with each slot 130 being open along a top edge of the flange 120. As shown in FIG. 12, the head assembly 101 includes one or more complementary male features 132 that are received within the respective slots 130 to establish a connection between the head assembly 101 and the main receptacle 110. Indicia 119 can be provided as part of the head assembly 101 for guiding the attachment of the head assembly 101 to the main receptacle 110. For example, the indicia 119 can be in the form of an arrow that points down. To lock the head assembly 101 to the main receptacle 110, the indicia 119 is aligned with the unlocked indicia 113 which allows the male feature 132 to be received within the open end of the slot 130 and then the head assembly 101 is rotated (twisted) relative to the main receptacle 110 to cause the male feature 132 to move to the other end of the slot 130 at which time the indicia (arrow) 119 is aligned with and points to the locked indicia 111.

The closure 400 is in the form of a housing and includes a first part 410 that can be thought of as being a lower housing and a second part 420 that can be thought of as being an upper housing. The first part 410 is a hollow structure that has a first portion 412 that has a cylindrical shape and a second portion 414 that is a flange (bill or brim shaped structure) that extends radially outward from the first portion 412. The second portion 414 has a rounded outer edge 415. As shown, a shoulder can be formed proximate the open top of the first part 410 with the opposite end of the first part 410 being a closed end defined by a floor that extends between the side wall of the first part 410. Along the floor of the first part 410 one or more bosses 440 and preferably a plurality of bosses 440 are formed. The bosses 440 can be cylindrical shaped. The bosses 440 are formed in the first portion 412 of the first part 410.

Figure 4:
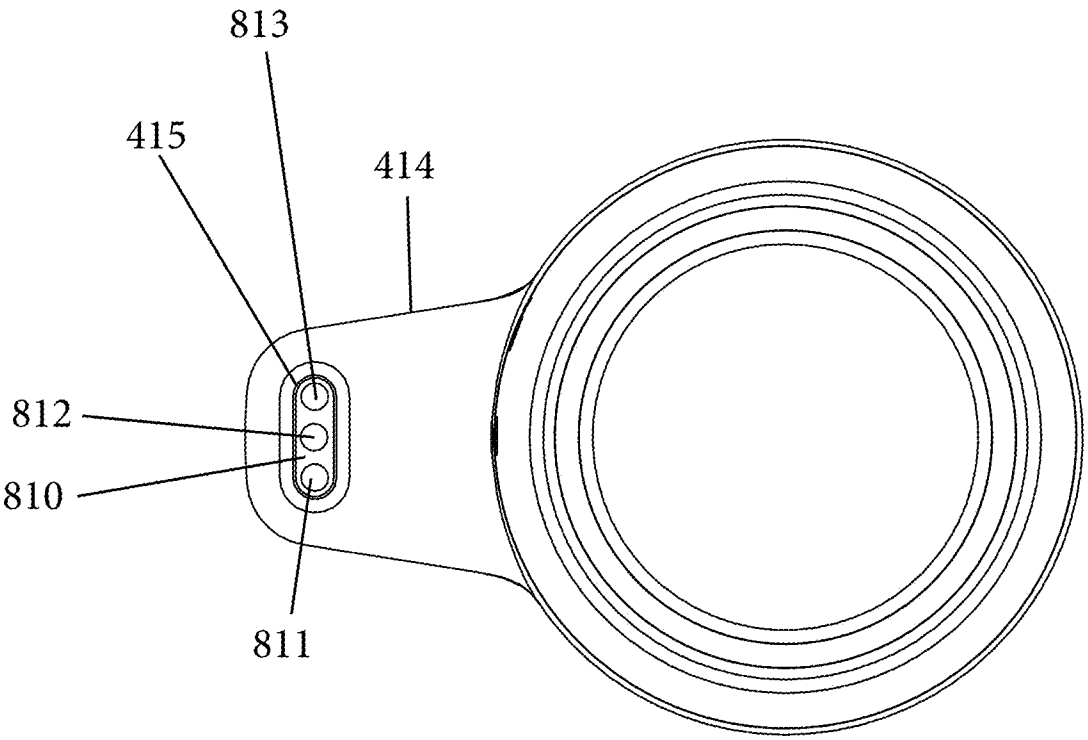
FIG. 4 is a bottom plan view thereof.

As shown in FIG. 4, an underside of the second portion 414 includes an opening or hole 415. In the illustrated embodiment, the hole 415 has an oblong shape.

The second part 420 has a complementary shape relative to the first part 410 and is meant to mate therewith to close off the first part 410. The second part 420 includes a recessed portion 422 that is formed along a top surface of the second part 420. A floor 424 defines a bottom of the recessed portion 422. As shown in FIG. 10A, the floor 424 represents a raised platform in that there is a recessed annular shaped channel 429 that is formed around the floor 424. In other words, the floor 424 is elevated relative to the bottom of the channel 429.

An opening 426 is formed in the floor 424 with an annular shaped inner wall 425 surrounding the opening 426 and protruding upwardly (upstanding) from floor 424. Along an underside of the second part 420 there are a plurality of mounting bosses (e.g., three mounting bosses) 427 that extend downwardly therefrom. The mounting bosses 427 are complementary to the bosses 440 and mate therewith to provide a means for fastening the second part 420 to the first part 410. For example, fasteners, such as screws or the like, can be used to connect the second part 420 to the first part 410. As such, the mounting bosses 427 are configured such that fasteners, such as screws, can "bite" into these structures to couple the parts together.

The second part 420 has a flange (bill or brim like structure) that mates with the flange of the first part 410. Along a top surface of this flange is indicia 421, such as an arrow that points toward the recessed portion 422 and acts as a locator/identifier for the selector 300 as described herein.

A bottom edge 423 of the second part 420 has a lip that is intended to mate with the shoulder formed along the open top of the first part 410, as shown in FIG. 10A, to provide a secure sealed fit between the two parts 410, 420.

The selector 300 is a rotatable part that is accessible to and manipulated by the user to select which reservoir 10, 20, 30 from which the fluid is drawn from. The rotatable selector 300 can have any number of shapes that are complementary to being received within the recessed portion 422 and being rotated therein. The illustrated selector 300 has rounded outer walls. As shown in the cross-sectional views, the selector 300 is a hollow structure and includes a first inner annular shaped wall 310 that extends downward from the top wall of the selector 300. Within the hollow interior of the first annular shaped wall 310 is a second annular shaped wall 320.

The selector 300 has a top surface 302 on which selector indicia is formed and in particular, the selector indicia can include indicia that identifies the contents of the individual reservoirs 10, 20, 30. Thus, as shown, there can be a first identifier 303, such as a first label, that identifies the contents of the first reservoir 10; a second identifier 304, such as a second label, that identifies the contents of the second reservoir 20; and a third identifier 305, such as a third label, that identifies the contents of the third reservoir 30. It will be appreciated that the dispenser 100 can come with a plurality of blank labels to allow the user to write on each label the contents of each reservoir 10, 20, 30. The selector 300 is rotatable relative to the closure 400 and the actuation of one of the reservoirs 10, 20, 30 is indicated by alignment of the indicia (arrow) 421 with one of the first identifier 303, second identifier 304, and third identifier 305. More specifically and in other words, when the first identifier 303 aligns within indicia 421, the first reservoir 10 is actuated and the fluid contained therein can be dispensed; when the second identifier 304 aligns within indicia 421, the third reservoir 30 is actuated and the fluid contained therein can be dispensed; and when the third identifier 305 aligns within indicia 421, the second reservoir 20 is actuated and the fluid contained therein can be dispensed.

A return spring 330 is disposed about the annular shaped inner wall 425 and seats at one end against the floor 424. The other end of the return spring 330 is disposed about the first annular shaped wall 310. The spring 330 acts as a return spring in that after the selector 300 is depressed to select which reservoir 10, 20, 30 is actuated, and then released, the selector 300 is returned to its raised position.

As shown in the figures, along an inner surface of the annular shaped inner wall 425, there is a plurality of longitudinally extending notches 430 that are spaced circumferentially about the inner surface. As shown, each notch 430 can have an arcuate shape and in particular, can have a generally triangular shape or a semi-circular concave shape. The notches 430 can be evenly spaced about the inner surface and in particular can be located 120 degrees apart.

As shown in the figures, the actuator 200 is a part which is operatively and fixedly coupled to the selector 300 such that the actuator 200 and selector 300 move in unison. The actuator 200 can be in the form of a cylindrical part that has a first end 202 and an opposing second end 204. The first end 202 is the end which faces the selector 300 and the second end 204 faces away. The actuator 200 is a generally hollow structure with an inner wall 210 that extends across the hollow interior of the actuator 200. The inner wall 210 is a transverse wall that extends horizontally. The inner wall 210 divides the inside of the actuator 200 into a first (upper) space 212 that is located above the inner wall 210 and a second (lower) space 214 that is located below the inner wall 210. A center boss 220 is integrally formed with the inner wall 210 and protrudes upwardly therefrom. The center boss 220 can be an annular shaped member with a center bore passing therethrough.

The first end 202 of the actuator body includes a top edge 203 that has one or more upstanding tabs 205. As shown, there can be two tabs 205 that protrude upwardly from the top edge 203 and can have a rectangular shape. The two tabs 205 are spaced circumferentially apart and since the top edge 203 is a curved edge, each tab 205 has an arcuate shape. The tabs 205 lock into adjacent slots on the underside of the selector 300. The tabs 205 make sure the selector 300 and actuator 200 are coupled in a way that they move together and act as one continuous part.

Along an outer surface proximate and at the first end 202, the actuator body includes a plurality of flexible locking fingers 230. The flexible fingers 230 are circumferentially spaced along the outer surface and in the illustrated embodiment, there are three flexible fingers 230 evenly spaced apart. Each flexible finger 230 extends in a circumferential direction. Each flexible finger 230 has a first end that is fixedly attached to the actuator body and an opposing free second end. The free second end of the flexible finger 230 has a locking or guide tab 240. The locking tab 240 has a complementary shape as the notch 430. The actuator body is configured such that the locking tabs 240 of the flexible fingers 230 are received within the complementary notches 430. The flexing action of the fingers 230 allows the actuator body to rotate relative to the annular shaped inner wall 425 and to disengage from the notches 430. The angled nature of the locking tabs 240 thus acts as a cam to allow the locking tabs 240 to ride out of the respective notches 430 and seat against the inner surface of the annular shaped inner wall 425 outside of the notches 430 due to the flexing nature of the fingers 230.

It will be seen that the flexible fingers 230 are located about the center boss 220 with an annular shaped space formed between the outer surface of the center boss 220 and the inner surface of the actuator body.

The second end 204 of the actuator body can include a plurality of notches or slots 245 that are open at the second end 204 as shown. These slots 245 are circumferentially spaced about the open second end 204 of the actuator body. The slots 245 allow the actuator 300 to slide all the way down. If the slots 245 were not there, then the bottom edge of the actuator 200 would hit the pump plugs 650 and prevent the pump assembly from becoming fully depressed.

Between the first end 202 and the second end 204 of the actuator body there is an outwardly extending protrusion 250. The protrusion 250 can have a tongue shape with a pair of opposing side walls and distal end wall that can be curved. As described herein, the protrusion 250 acts as a mechanism for actuating one pump mechanism that is associated with the selected reservoir 10, 20, 30. An underside of the protrusion 250 is a flat surface.

The dispenser 100 also includes a pump mechanism that is configured to pump fluid from a respective reservoir and in particular, each reservoir 10, 20, 30 has a dedicated pump mechanism that can be independently selected for causing dispensing of the fluid within the selected reservoir 10, 20, 30 along a dedicated flow path. As described herein, the dedicated flow path results in the fluids from the reservoirs 10, 20, 30 being completely separated from the reservoir itself all the way to an outlet port (dispensing outlet/manifold) through which the fluid is dispensed. As shown, the pump mechanism is formed of a number of parts that can be assembled to form a pump sub-assembly that can then be mated to the other sub-assemblies of the dispenser 100.

The pump mechanism includes a pump housing 500 that includes a disk-shaped base with an upstanding center post 510. The center post 510 has a faceted surface in that an outer surface of the center post 510 includes a plurality of curved facets 512 with a plurality of flats 514 located between the curved facets 512. The curved facets 512 have concave shapes. In the illustrated embodiment, there are three curved facets 512 and three flats 514. The actuator 200 rotates about the center post 510. The pump housing 500 also includes a plurality of openings 520 are in the form of through holes that are formed through the disc-shaped base. The number of openings 520 should equal the number of reservoirs 10, 20, 30 and in the illustrated embodiment, there are three openings 520. The center post 510 is located at a center of the disk-shaped base internally between the openings 520.

The pump housing 500 also includes a plurality of bosses 530 that represent cylindrical shaped protrusions that extend upwardly from a top surface of the disc-shaped base and includes a top wall with a center opening formed therethrough. The bosses 530 are located between the openings 520. The bosses 530 are positioned so as to mate with the bosses 427 that extend downwardly from an underside of the second part 420 of the closure 400 with fasteners passing through the center holes of each to allow the pump housing 500 to be attached to second part 420. The pump housing 500 is thus fixedly attached to closure 400.

The pump mechanism includes a pump 600 and as mentioned herein, each reservoir 10, 20, 30 has its own dedicated pump 600. As a result, the dispenser 600 has three pumps 600. Each pump 600 is configured to, when actuated, pump a discrete amount of fluid that is contained within the respective reservoirs 10, 20, 30 along a respective dedicated flow path to the dedicated dispensing outlet.

Figure 9:
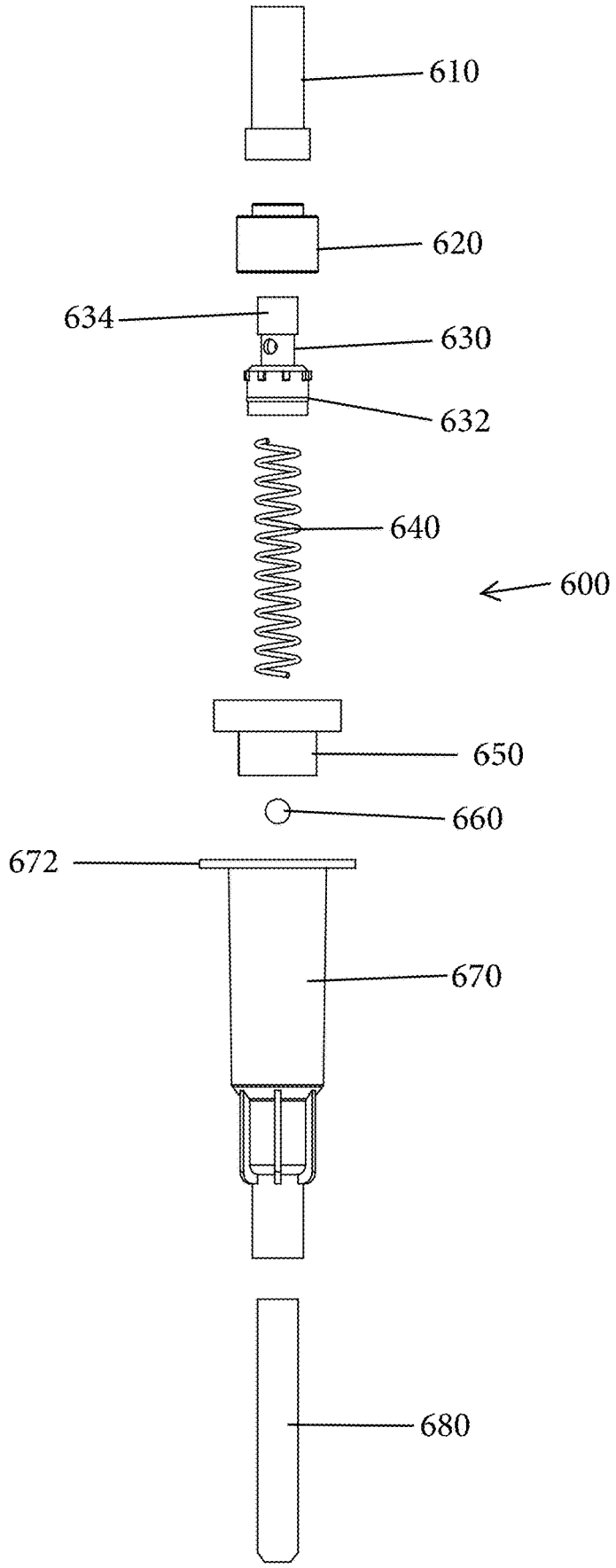
FIG. 9 is an exploded side elevation view of an exemplary pump assembly.

As best shown in FIG. 9, the pump 600 is formed of a number of parts that cooperate with one another to form a joined elongated structure. For example, the pump 600 is defined at one end by a plunger post 610 which is an elongated cylindrical shaped structure that can have a variable diameter with one end having a first diameter and the other end having a second diameter that is greater than the first diameter so as to create a shoulder (right angle shoulder) between the two sections. As shown inside of the plunger post is an area of reduced diameter that defines a piston seat 612.

Figure 11B:
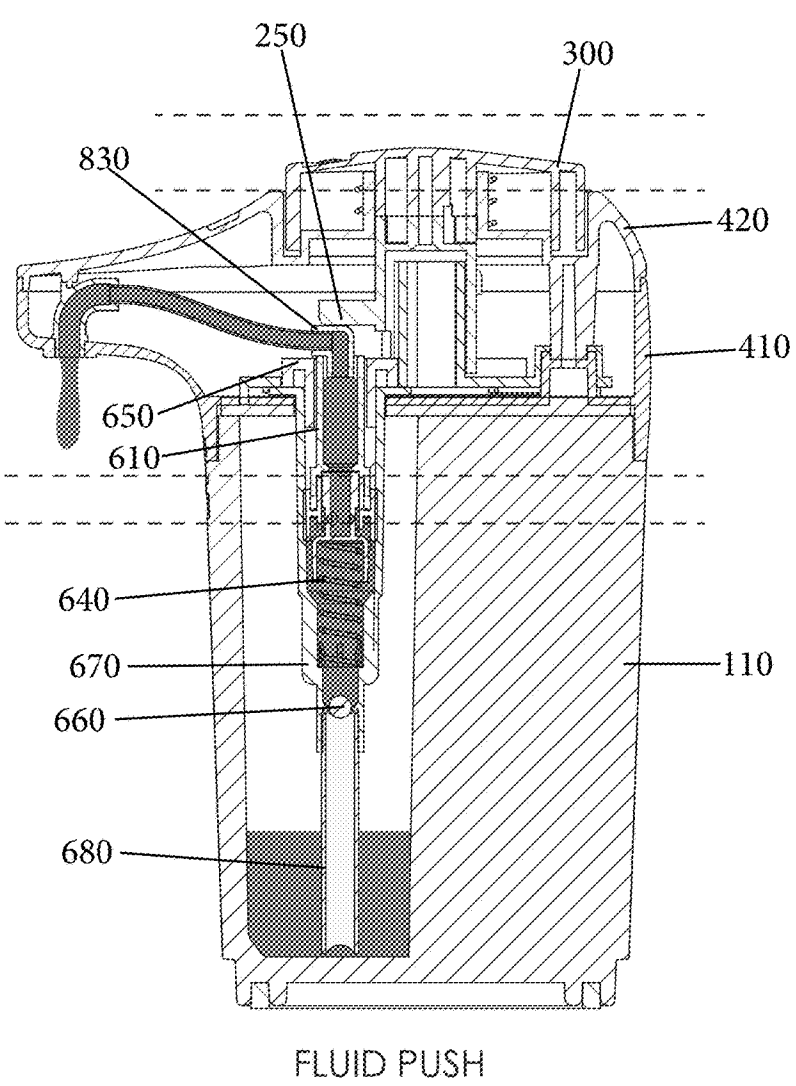
FIGS. 11A and 11B are cross-sectional view of the pump assembly showing a spraying action fluid flow with FIG. 11A showing fluid flow during a fluid pull position and FIG. 11B showing fluid flow during a fluid push position.
Figure 11A:
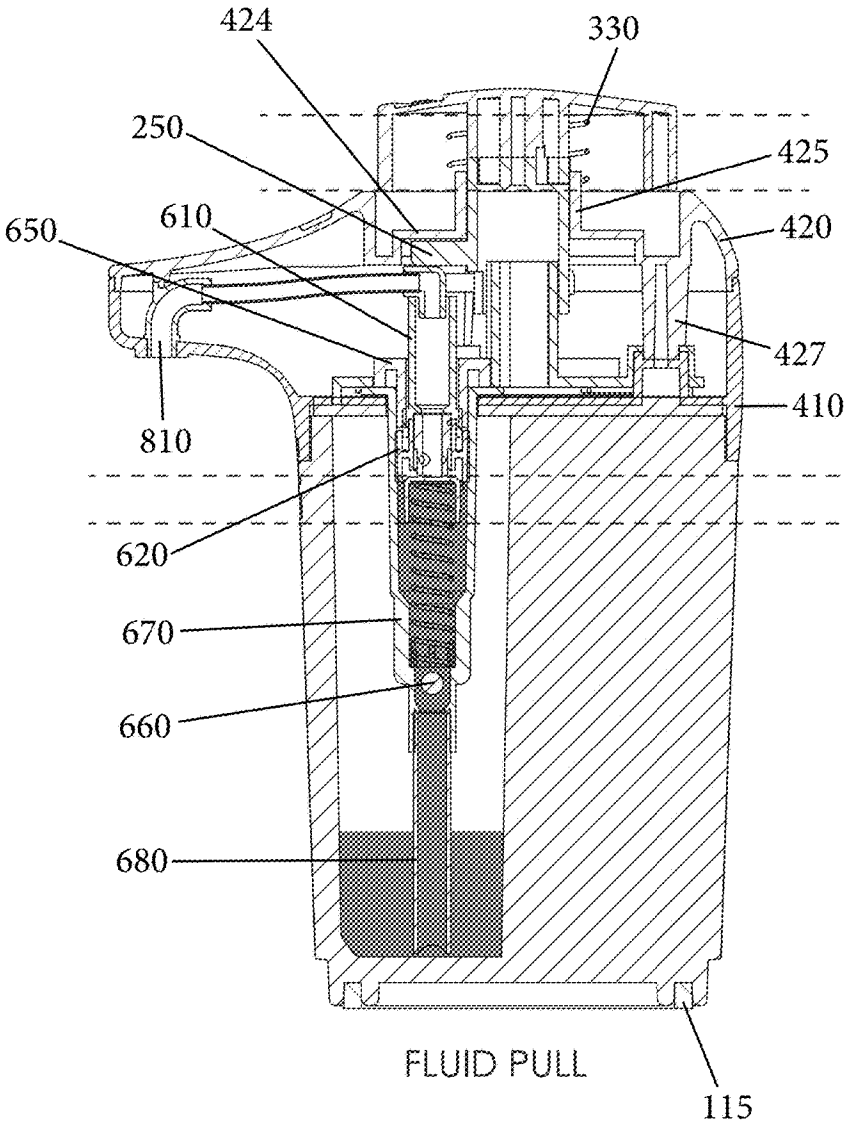

A plunger 620 comprises a cylindrical shaped part that has a reduced diameter center portion at one end that mates with the plunger 610. As shown in FIGS. 11A and 11B, the plunger 620 includes an annular shaped channel that is formed between the reduced diameter center portion and an outer wall. The annular shaped channel receives the other end of the plunger post 610 to couple the plunger post 610 to the plunger 620.

A spring stopper 630 is provided and includes a hollow base portion 632 that has a greater diameter than the other portion 634 of the spring stopper 630. One end of the spring 640 is received within the hollow base portion 632. The other portion 634 is received within the hollow interior of the plunger 620. In the fluid push position of FIG. 11B, the other portion 634 seats against the piston seat 612. There is also a pump plug 650.

The pump also includes a pump body 670 that is a hollow structure with an increased diameter flange 672 at one end and a stepped construction. As shown in FIG. 12, there is an internal spring seat 673 against which one end of the spring 640 seats. Also defined inside of the internal hollow space of the pump body 670 is a valve seat 675 that has a reduced diameter and in the fluid push position of FIG. 11B, a valve ball 660 seats so as to block fluid flow within the pump body 670. In the fluid pull position of FIG. 11A, the valve ball 660 is not seated against the valve seat 675 and is spaced therefrom so as to allow fluid flow within the pump body 670. A conduit 680 is coupled to one open end of the pump body 670. The conduit 680 comprises an elongated hollow tube that is placed into one of the reservoirs 10, 20, 30 for drawing up fluid from the reservoir during a fluid pull operation. The conduit 680 leads to the pump mechanism so that fluid drawn into the pump mechanism can then be dispensed. The conduit 680 can thus be thought of a straw-like structure that has a free end that is spaced above or event in select contact with the floor of the reservoir.

Since there are three independent reservoirs 10, 20, 30, there are three pumps 600.

A gasket 700 is also provided and is in the form of a disk-shaped structure that includes a plurality of openings 710 (circular shaped holes). The openings 710 axially align with the openings 520 that are formed in the pump housing 520 as well as openings formed in the floor of the first part 410 of the closure 400. As described herein, the gasket 700 is disposed between the top edge of the main receptacle 110 and the underside of the first part 410 of the closure 400.

The gasket 700 can be formed of any number of different material including but not limited to elastic materials, such as rubber.

The assembly of the pump 600 is now described. The pump housing 500 is disposed within the hollow interior of the first part 410 with the bosses 530 of the pump housing 500 receiving the bosses 440 formed on the floor of the first part 410. As further shown, the bosses 427 of the second part 420 are also received within the bosses 530 and fasteners that pass through these three aligned structure are used to fixedly couple the first part 410, the pump housing 500 and the second part 420. The center post 510 of the pump housing 500 is received within the hollow interior of the actuator 200 which itself is slidably disposed within the annular shaped wall 425 of the second part 420 of the closure 400. As mentioned previously, the actuator 200 and the selector 300 are fixedly attached to one another to form a joined structure that can move both axially within the jointed structure and can rotate therein and relative thereto. As described herein, rotation of the selector 300 controls which reservoir 10, 20, 30 is selected for actuation and axial movement of the joined structure generates a pumping action.

The various components of the pump 600 are connected to one another to form an elongated pump sub-assembly that is then mated with the closure 400 and the pump housing 500. The assembled pump 600 is passed through the aligned openings 710, 520 and the openings in the floor of the first part 410. It will be seen that when the pump mechanism is assembled, the flange 672 does not pass through the opening 520 but instead seats against the underside of the pump housing 500. The plunger post 610 represents the topmost part and is exposed and faces the underside of the selector 300. The plunger post 610 is thus position above the floor of the first part 410 and the plunger 620 lies within the holes formed in the floor of the first part 410.

The dispenser 100 also includes a manifold and conduit assembly for receiving and then dispensing of fluids from the reservoirs 10, 20, 30 in a manner in which each fluid is maintained separate from the other fluids along its entire flow path from the respective reservoir to the dispensing outlet. More specifically, there are a plurality of connectors 830 (pump tube tops) that are configured to attach to the open end of the plunger post 610 so as to place in fluid communication the hollow center of the connector 830 and the hollow center of the plunger post 610. As illustrated, the connectors 830 can be elbow shaped (right angle) connectors. The connectors 830 fluidly connect to a plurality of conduits that deliver the fluid from the pumps 600 to the dispensing outlet. In the illustrated embodiment, there are three conduits since there are three reservoirs 10, 20, 30 and in particular, there is a first dispensing conduit 821, a second dispensing conduit 822 and a third dispensing conduit 823. The dispensing conduits 821, 822, 823 can be the same or, as shown, they can be different in that the second dispensing conduit 822 has a shorter length compared to the conduits 821, 823 (which can have the same length). The conduits 821, 822, 823 can be in the form of circular tubes. One end of each of the conduits 821, 822, 823 is mated with one of the connectors 830 so as to fluidly connect the respective reservoirs 10, 20, 30 to the conduits 821, 822, 823 and more particularly, the first dispensing conduit 821 fluidly connects to the second reservoir 20, the second dispensing conduit 822 fluidly connects to the first reservoir 10, and the third dispensing conduit 823 fluidly connects to the third reservoir 30. As shown in the figures, the three pumps 600 can generally be thought of as being arranged in a triangle and thus, the shorter second conduit 822 is the conduit that extends from the dispensing outlet to the pump 600 that is closest to the dispensing outlet (dispensing manifold), with the other two pumps 600 being further away from the dispensing outlet and thus, the requirement of longer length conduits 821, 823.

The free ends of the first dispensing conduit 821, the second dispensing conduit 822 and the third dispensing conduit 823 mate with a manifold 800. The manifold 800 has an end portion 810 that is received within the opening 415 formed in the first part 410. As shown, the manifold 800 includes a first manifold conduit 811, a second manifold conduit 812 and a third manifold conduit 813. The first manifold conduit 811, second manifold conduit 812 and third manifold conduit 813 are maintained separate from one another and terminate in dispensing openings in the end portion 810. Each of the first manifold conduit 811, second manifold conduit 812 and third manifold conduit 813 can be generally elbow-shaped (right angle) with the three dispensing openings being located side-by-side.

The cross-sectional figures illustrate the connection and routing of the conduits 821, 822, 823 with the manifold 800 and the three pumps 600 that are in fluid communication with the three reservoirs 10, 20, 30.

Pumping Action

The pump 600 operates similar to how traditional hand pumps operate. As mentioned herein, the user first selects one of the desired reservoirs 10, 20, 30 to dispense fluid from. To do this, the user rotates the selector 300 so that the indicia 421 points to the indicia (label) 303, 304, 305 that corresponds to the selected reservoir 10, 20, 30.

The notches 430 and locking tabs 240 are formed and located so as to ensure that the selector 300 remains locked in a position that directly corresponds to the selector 300 being locked in place with respect to a selected one of the reservoirs 10, 20, 30. This feature ensures that the selector 300 and actuator 200 cannot be positioned in a locked position that causes the protrusion 250 to be misaligned with respect to the pumps 600. The notches 430 also serve to provide the user with a tactile feel for when one of the reservoirs are selected. The user will feel the notch 430 slide into its slot and also a slight clicking sound will be created.

Figures 14A, 14B, 14C:
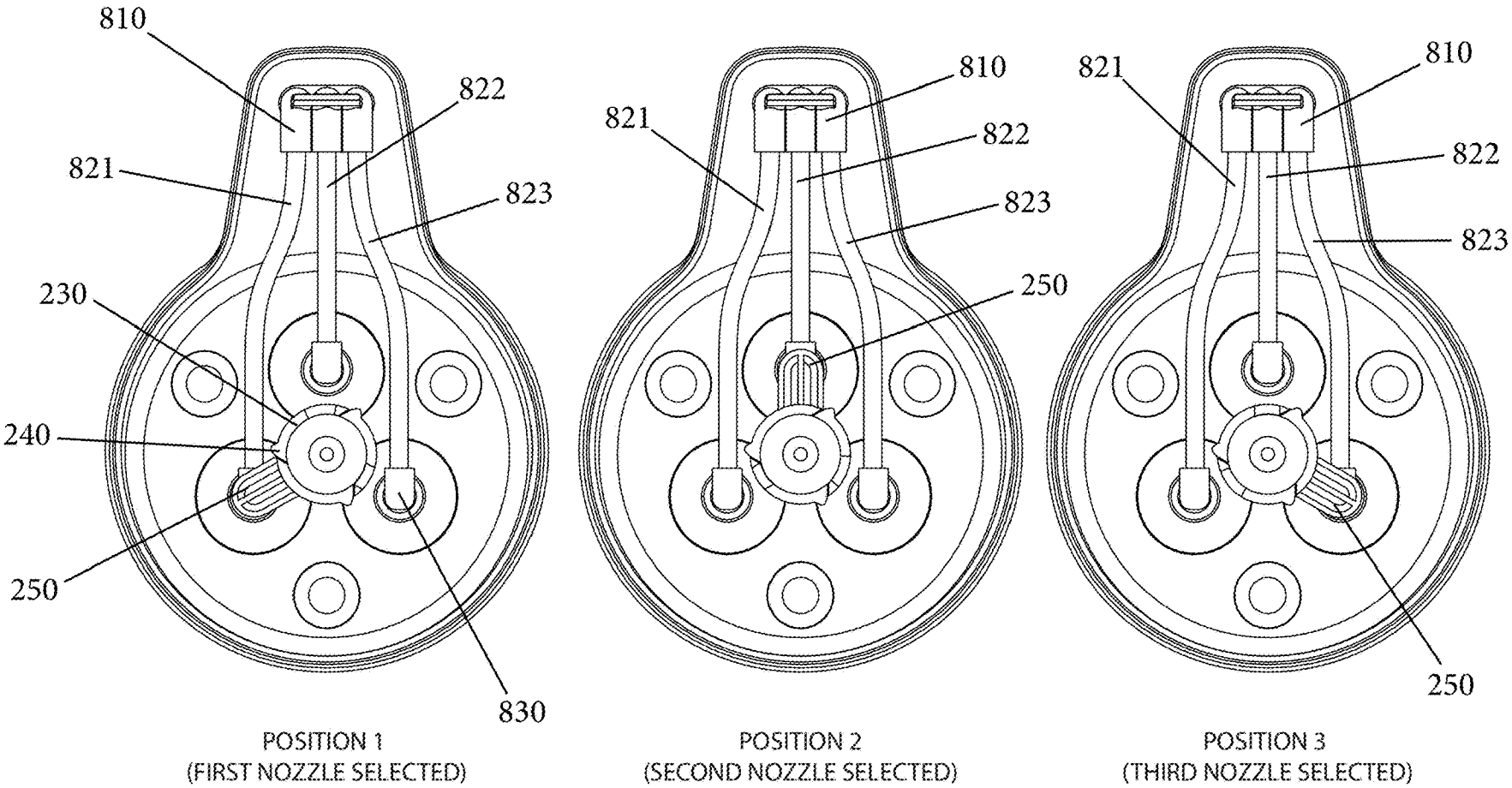
FIGS. 14A-14C illustrate a selector knob (actuator) of the dispenser and movement of the selector knob from a first selection (FIG. 13A) to a second selection (FIG. 13B) and then a third section (FIG. 13C)
Figure 15:
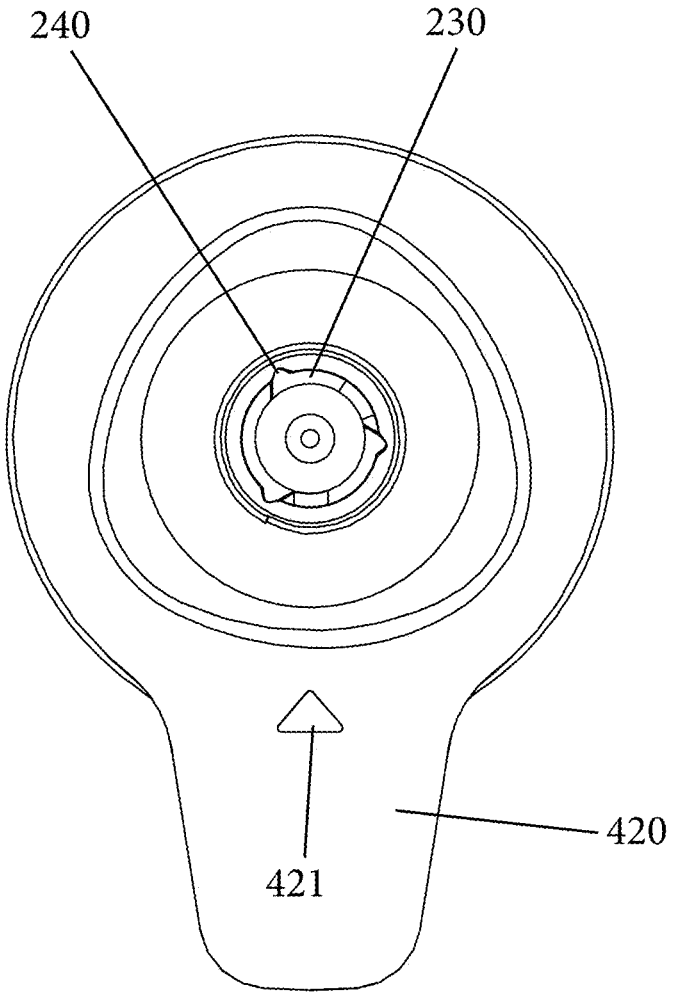
FIG. 15 is a top plan view with the selector knob removed.

Once the chosen reservoir 10, 20, 30 is chosen, then the user pumps fluid from the chosen reservoir 10, 20, 30 by pressing down the selector 300. Since the selector 300 is fixedly attached to the actuator 200, the downward pressing of the selector 300 is directly translated into downward movement of the actuator 200. As shown in FIG. 14A, when the second reservoir 20 is selected, the protrusion 250 is located over the connector 830 that is part of the pump 600 that is in fluid communication with the second reservoir 20 and similarly, as shown in FIG. 14B, when the first reservoir 10 is selected, the protrusion 250 is located over the connector 830 that is part of the pump 600 that is in fluid communication with the first reservoir 10. As shown in FIGS. 10A and 11A, prior to pressing down the selector 300, the springs 330, 640 are in the extended relaxed states resulting in the plunger post 610 being in a raised (up) position with the protrusion 250 being in contact with a top surface of the connector 830 associated with the selected reservoir 10, 20, 30. In this position which can be thought of as being a fluid pull position, the valve ball 660 is spaced away from the valve seat 673 and therefore the conduit 680 and the hollow interior collection space of the pump body 670 are in fluid communication, thereby allowing fluid from the reservoir to being drawn into this hollow interior collection space.

Once fluid is collected in this manner, to pump the collected fluid, the user simply presses down on the selector 300 causing the protrusion 250 of the actuator 200 to drive the plunger post 610 in a downward direction. This action can be thought of as being a fluid push operation since the valve ball 660 seats against the valve seat 673 to prevent the collected from traveling downward in a direction toward the conduit 680 and the selected reservoir itself. As result, the downward movement of the plunger causes expulsion of the collected fluid. The collected fluid travels upward within the plunger body 570 through the center holes of the plunger 620 and plunger post 610 and into the connector 830 where the fluid flows into the conduit 821, 822, 823 to the manifold 800 where it is expelled through the dedicated dispensing opening located thereat. It will be appreciated that in the fluid push operation, the springs 330, 640 compress. Once the fluid push operation is complete and a discrete quantity of fluid is expelled through the manifold 800, the user then releases the selector 300 and the return spring force of the springs 330, 640 causes both the plunger and the selector 300 to return to the at rest positions shown in FIGS. 10A and 11A.

It will be appreciated that for the non-selected reservoirs 10, 20, 30 no dispensing of fluid occurs since the protrusion 250 is only positioned over one of the reservoirs 10, 20, 30 and thus, only actuates a single reservoir 10, 20, 30 at one given time. As the selector 300 and actuator 200 are pressed down, the protrusion 250 passes by the connectors 830 associated with the non-selected reservoirs 10, 20, 30. As a result, no pumping action occurs with the non-selected reservoirs 10, 20, 30.

Reservoir Selection Process

Figures 13A, 13B, 13C:
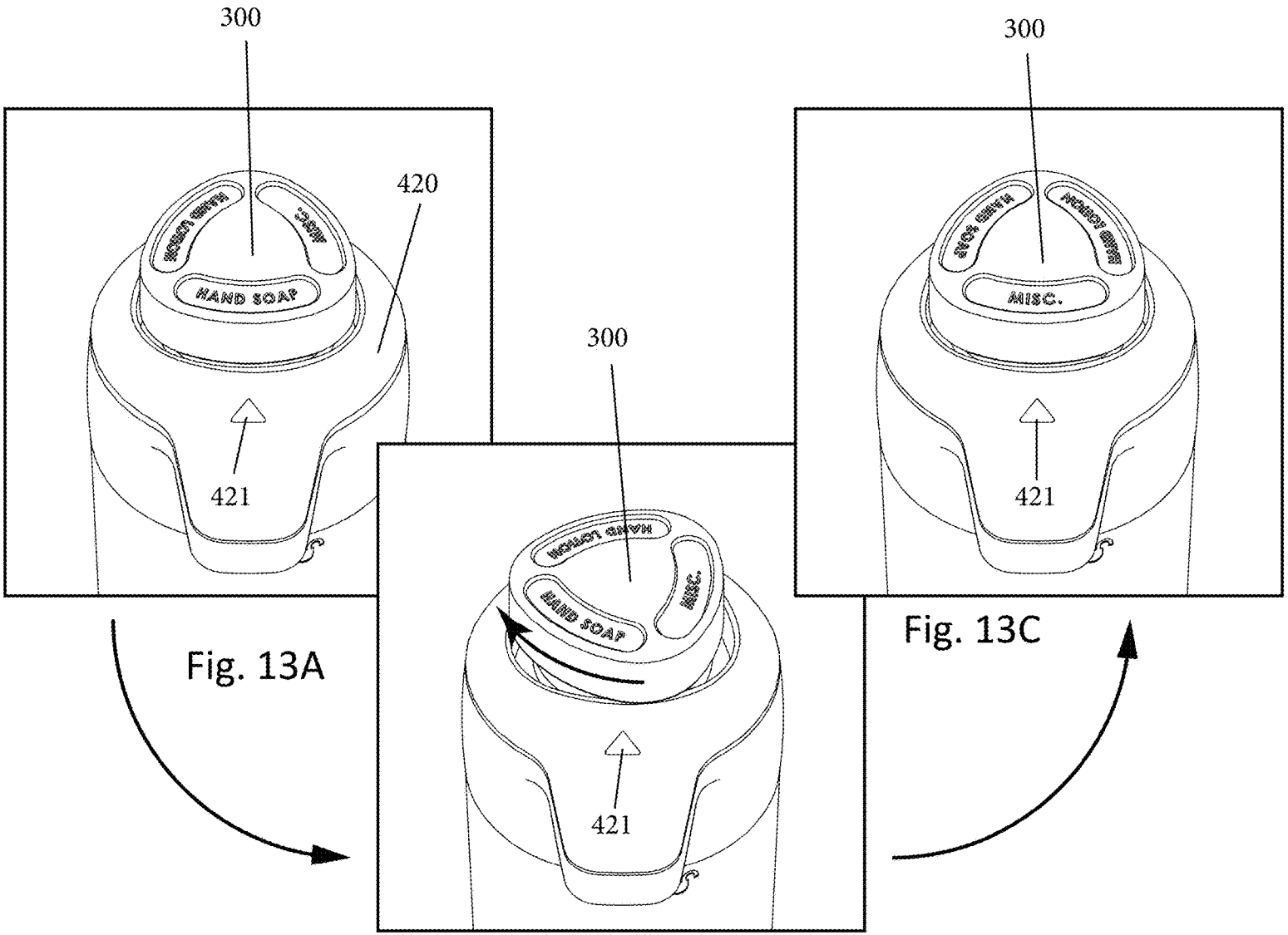
FIGS. 13A-13C illustrate a selector knob (actuator) of the dispenser and movement of the selector knob from a first selection (FIG. 13A) to an intermediate position (FIG. 13B) and then a second section (FIG. 13C)

FIGS. 13A-13C show the manner in which the selector 300 is used to select the respective reservoir 10, 20, 30 for dispensing of fluid therefrom. FIG. 13A shows selection of one reservoir (e.g., first reservoir 10) by aligning one side of the selector 300 to the indicia 421; FIG. 13B shows movement of the selector 300 from one position to another and FIG. 13C shows selection of another reservoir (e.g., second reservoir 20) by aligning another side of the selector 300 to the indicia 421.

FIG. 14A shows the second reservoir 20 selected in which case the protrusion 250 of the actuator 200 is aligned with the pump 600 that is associated with and in fluid communication with the second reservoir 20. As shown, the protrusion 250 is positioned over the connector 830 that is part of the pump 600 associated with the second reservoir 20. Pressing the selector 300 causes the actuator 200 to move downward and thus, the protrusion 250 likewise moves downward into contact with the connector 830. The downward movement of the protrusion 250 presses down the connector 830 which causes actuation of the pump 600 due to the connector 830 being attached to the plunger post 610 as discussed above causing fluid from the second reservoir 20 to be pumped therefrom.

FIG. 14B shows the first reservoir 10 selected in which case the protrusion 250 of the actuator 200 is aligned with the pump 600 that is associated with and in fluid communication with the first reservoir 10. As shown, the protrusion 250 is positioned over the connector 830 that is part of the pump 600 associated with the first reservoir 10. Pressing the selector 300 causes the actuator 200 to move downward and thus, the protrusion 250 likewise moves downward into contact with the connector 830. The downward movement of the protrusion 250 presses down the connector 830 which causes actuation of the pump 600 due to the connector 830 being attached to the plunger post 610 as discussed above causing fluid from the first reservoir 10 to be pumped therefrom.

FIG. 14C shows the third reservoir 30 selected in which case the protrusion 250 of the actuator 200 is aligned with the pump 600 that is associated with and in fluid communication with the third reservoir 30. As shown, the protrusion 250 is positioned over the connector 830 that is part of the pump 600 associated with the third reservoir 30. Pressing the selector 300 causes the actuator 200 to move downward and thus, the protrusion 250 likewise moves downward into contact with the connector 830. The downward movement of the protrusion 250 presses down the connector 830 which causes actuation of the pump 600 due to the connector 830 being attached to the plunger post 610 as discussed above causing fluid from the third reservoir 30 to be pumped therefrom.

In the foregoing manner, the selector 300 is configured to only engage one reservoir at a time to perform the pumping operation. Since as described herein, the entire fluid flow path from the reservoir to the dispensing outlet (nozzle) is maintained independent and spatially separated from the other fluid flow paths and therefore cross-contamination does not occur. This allows the reservoirs to be filled with liquids that are much different from one another. For example, in one configuration intended for personal care products, one reservoir can be filled with hand soap, one can be filled with shampoo, and the other can be filled with hair conditioner. For car cleaning chores, one reservoir can be filled with leather cleaner/conditioner, one can be filled with interior cleaner and one can be filled with liquid paint wax. The combination of liquids is vast and safe given the construction of the dispenser of the present invention. Unlike conventional multi-reservoir dispensers, the manifold itself maintains separation of the fluid flow paths from the various reservoirs and at no time from flowing from the reservoir to the pump mechanism and then be pumped to and through the manifold and dispensing outlet does the fluid come into contact with fluid from any of the other reservoirs.

It will also be appreciated that the present invention includes plural pump mechanisms that are configured so as to be selected so as to activate the pumping of one reservoir, while the other reservoir or reservoirs are placed in an off-line state. The plunger engaging mechanism (actuator 300) is only configured to engage one plunger at a given time and therefore, it is not possible to have multiple plungers activated at the same time resulting in a comingled fluid dispensing.

It will also be understood, as previously mentioned, that the dispenser 100 can contain 2, 3 or 4 or more reservoirs with each having discrete pumping architecture.

In addition, it will be appreciated that the dispenser can dispense liquids, creams, gels, etc.

It will also be appreciated that the selector 300 and actuator 200 can be designed so as to not be fixedly attached to one another but instead, the selector 300 and actuator 200 can be separate from one another. In particular, the selector 300 can be a part that is used to select the reservoir and another button, such as the actuator 200, can be used to dispense the contents of the reservoir.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A multi reservoir dispenser comprising:

a main receptacle having a first reservoir for holding a first fluid and a second reservoir for holding a second fluid;

a first pump mechanism in fluid communication with the first reservoir via a first flow path, the first pump mechanism having a first displaceable plunger;

a second pump mechanism in fluid communication with the second reservoir via a second flow path, the second pump mechanism having a second displaceable plunger;

a closure for covering an open end of the main receptacle, the closure having a dispensing opening;

a manifold having a first orifice in fluid communication with the first flow path and a second orifice in fluid communication with the second flow path, the manifold being disposed within the dispensing opening;

an actuator assembly comprising a selector and actuator, that is coupled to the selector, the actuator assembly being movable between: (a) a first position in which only the first displaceable plunger of the first pump mechanism is actuated by the actuator for discharging only the first fluid through the first orifice of the manifold by causing the first fluid to flow along the first flow path; and (b) a second position in which only the second displaceable plunger of the second pump mechanism is actuated by the actuator for discharging only the second fluid through the second orifice of the manifold by causing the second fluid to flow along the second flow path, wherein the actuator assembly is both rotatable to select one of the first pump mechanism and the second pump mechanism and is displaceable in an axial direction to generate a pumping action; and a pump housing disposed within the closure and having a post that receives the actuator and the actuator rotates thereabout;

wherein the first flow path and the second flow path are fluidly isolated from one another along an entire length from the first reservoir to the first orifice and from the second reservoir to the second orifice, respectively;

wherein the actuator includes a single protrusion that makes direct contact with only one of the first displaceable plunger and the second displaceable plunger at any one time for dispensing the first fluid and second fluid, respectively.

2. The dispenser of claim 1, wherein the pump housing includes a first opening through which the first displaceable plunger passes and a second opening through which the second displaceable plunger passes.

3. The dispenser of claim 1, wherein the actuator is detachably coupled to an underside of the selector.

4. The dispenser of claim 1, wherein the closure includes a first part that is detachably coupled to an open end of the main receptacle and a second part that is coupled to the first part and encloses the second part, the second part having a recessed portion in which the selector is disposed and both rotates and moves in the axial direction.

5. The dispenser of claim 4, wherein the recessed portion includes a floor in which an opening is formed and an annular shaped wall is formed around the opening, the selector includes an inner wall that depends downwardly from a top wall and is received within a hollow interior of the annular shaped wall, the actuator also being received within the hollow interior and being fixedly attached to the inner wall.

6. The dispenser of claim 5, wherein the actuator includes an outwardly extending protrusion that selectively contacts the first pump mechanism when the actuator assembly is in a first selector position and selectively contacts the second pump mechanism when the actuator assembly is in a second selector position.

7. The dispenser of claim 6, wherein an inner surface of the annular shaped wall includes a plurality of longitudinally extending notches and the actuator includes a plurality of flexible fingers that include locking tabs that selectively engage the notches for locking the actuator assembly in one of the first selector position and the second selector position.

8. The dispenser of claim 7, wherein the flexible fingers extend circumferentially about an outer surface of the actuator with one end of each flexible finger being integral and attached to a body of the actuator.

9. The dispenser of claim 4, wherein the pump housing includes a plurality of first bosses and a plurality of first openings, the second part having a plurality of second bosses that extend downwardly from an underside of the second part and are received within the first bosses, the first part including a plurality of third bosses that are received within the first bosses, the first bosses, second bosses and third bosses having axially aligned central holes for receiving fasteners for fixedly connecting the second part, the pump housing and the first part, with the pump housing being disposed along a floor of the first part.

10. The dispenser of claim 9, wherein each of the first pump mechanism and the second pump mechanism includes a pump body that has a flange at a first end that extends radially outward, the flange being disposed between and seating against an underside of the pump body and the floor of the first part.

11. The dispenser of claim 1, wherein the main receptacle has a third reservoir for holding a third fluid and the dispenser further includes a third pump mechanism in fluid communication with the third reservoir via a third flow path, the third pump mechanism having a third displaceable plunger, the manifold having a third orifice in fluid communication with the third flow path, the actuator assembly being positionable in a third position in which only the third displaceable plunger of the third pump mechanism is actuated by the actuator for discharging only the third fluid through the third orifice of the manifold by causing the third fluid to flow along the third flow path, wherein the first flow path, the second flow path and the third flow path are fluidly isolated from one another along an entire length from the first reservoir to the first orifice and from the second reservoir to the second orifice and from the third reservoir to the third orifice, respectively.

12. The dispenser of claim 1, wherein the selector is coupled to a return spring that is disposed between the selector and the closure, wherein the return spring surrounds the actuator.

13. The dispenser of claim 1, wherein the selector is rotatable 360 degrees.

14. The dispenser of claim 1, wherein the actuator is coupled to a center of the selector.

15. A multi reservoir dispenser comprising:

a main receptacle having a first reservoir for holding a first fluid and a second reservoir for holding a second fluid;

a first pump mechanism in fluid communication with the first reservoir via a first flow path, the first pump mechanism having a first displaceable plunger;

a second pump mechanism in fluid communication with the second reservoir via a second flow path, the second pump mechanism having a second displaceable plunger;

a closure for covering an open end of the main receptacle, the closure having a dispensing opening;

a manifold having a first orifice in fluid communication with the first flow path and a second orifice in fluid communication with the second flow path, the manifold being disposed within the dispensing opening;

an actuator assembly comprising a selector and actuator, that is coupled to the selector, the actuator assembly being movable between: (a) a first position in which only the first displaceable plunger of the first pump mechanism is actuated by the actuator for discharging only the first fluid through the first orifice of the manifold by causing the first fluid to flow along the first flow path; and (b) a second position in which only the second displaceable plunger of the second pump mechanism is actuated by the actuator for discharging only the second fluid through the second orifice of the manifold by causing the second fluid to flow along the second flow path, wherein the actuator assembly is both rotatable to select one of the first pump mechanism and the second pump mechanism and is displaceable in an axial direction to generate a pumping action; and a pump housing disposed within the closure and having a post that receives the actuator and the actuator rotates thereabout;

wherein the first flow path and the second flow path are fluidly isolated from one another along an entire length from the first reservoir to the first orifice and from the second reservoir to the second orifice, respectively;

wherein the closure includes a first part that is detachably coupled to an open end of the main receptacle and a second part that is coupled to the first part and encloses the second part, the second part having a recessed portion in which the selector is disposed and both rotates and moves in the axial direction;

wherein the first part includes a plurality of first holes and the dispenser further includes a pump housing that is disposed along a floor of the first part of the closure and includes a plurality of second holes that receive first ends of the first pump mechanism and the second pump mechanism, each first end having a displaceable plunger and a plunger post that extends above a floor of the pump housing, the first holes and the second holes being axially aligned, the actuator being configured to engage and drive the plunger post of the first pump mechanism in the axial direction when the selector assembly is in the first selector position and being configured to engage the plunger post of the second pump mechanism in the axial direction when the selector assembly is in the second selector position.

16. The dispenser of claim 15, further including a first fluid connector coupled to the plunger post of the first pump mechanism and a second fluid connector coupled to the plunger post of the second pump mechanism, wherein a first fluid conduit is fluidly connected between the manifold and the first connector and a second fluid conduit is fluidly connected between the manifold and the second connector, wherein the actuator includes an outwardly extending protrusion that selectively contacts and drives the first connector in the axial direction when the actuator assembly is in the first selector position and selectively contacts and drives the second connector in the axial direction when the actuator assembly is in the second selector position.

17. The dispenser of claim 15, wherein the manifold comprises a single manifold body that has a first flow path that connects to the first fluid connector and terminates in the first orifice and a second flow path that connects to the second fluid connector and terminates in the second orifice.

18. The dispenser of claim 16, wherein the outwardly extending protrusion is disposed below an underside of a floor that defines the recessed portion of the second part, the floor defining a maximum raised position of the outwardly extending protrusion.

19. A multi reservoir dispenser comprising:

a first reservoir for holding a first fluid and a second reservoir for holding a second fluid;

a first pump mechanism in fluid communication with the first reservoir via a first flow path;

a second pump mechanism in fluid communication with the second reservoir via a second flow path;

a closure for covering an open end of the first reservoir and the second reservoir;

a first dispensing orifice in fluid communication with the first flow path and a second dispensing orifice in fluid communication with the second flow path; and an actuator assembly comprising a selector and actuator, that is fixedly attached to the selector, the selector being disposed within a recessed hollow space of the closure, the actuator assembly being movable between: (a) a first position in which only the first pump mechanism is actuated by the actuator for discharging only the first fluid through the first dispensing orifice by causing the first fluid to flow along the first flow path; and (b) a second position in which only the second pump mechanism is actuated by the actuator for discharging only the second fluid through the second dispensing orifice by causing the second fluid to flow along the second flow path, wherein the actuator assembly is both rotatable to select one of the first pump mechanism and the second pump mechanism and is displaceable in an axial direction to generate a pumping action;

wherein the first flow path and the second flow path are fluidly isolated from one another along an entire length from the first reservoir to the first orifice and from the second reservoir to the second orifice, respectively;

wherein the closure has a flange portion that extends radially outward and an underside thereof has an opening that faces downward and in which the first dispensing opening and the second dispensing opening are located, each of the first dispensing opening and the second dispensing opening facing downward.

20. The dispenser of claim 19, wherein the closure includes a first part that is detachably coupled to an open end of the main receptacle and a second part that is coupled to the first part and encloses the second part, the second part having a recessed portion in which the selector is disposed and both rotates and moves in the axial direction, wherein a bottom wall of the second part has a first opening and an annular shaped wall that is formed around the first opening, the selector includes an inner wall that extends downwardly from a top wall and is received within a hollow interior of the annular shaped wall, the actuator also being received within the hollow interior of the annular shaped wall and being fixedly attached to the inner wall to fixedly attach the selector to the actuator.

21. The dispenser of claim 20, wherein the actuator includes an outwardly extending protrusion that selectively contacts the first pump mechanism when the actuator assembly is in a first selector position and selectively contacts the second pump mechanism when the actuator assembly is in a second selector position.

22. The dispenser of claim 21, wherein an inner surface of the annular shaped wall includes a plurality of longitudinally extending notches and the actuator includes a plurality of flexible fingers that include locking tabs that selectively engage the notches for locking the actuator assembly in one of the first selector position and the second selector position.

23. The dispenser of claim 19, wherein the first reservoir and the second reservoir are both part of a main receptacle that includes a divider that partitions a hollow interior of the main receptacle into the first reservoir and the second reservoir.

24. A multi reservoir dispenser comprising:

a main receptacle having a first reservoir for holding a first fluid and a second reservoir for holding a second fluid;

a first pump mechanism in fluid communication with the first reservoir via a first flow path, the first pump mechanism having a first displaceable plunger;

a second pump mechanism in fluid communication with the second reservoir via a second flow path, the second pump mechanism having a second displaceable plunger;

a closure for covering an open end of the main receptacle, the closure having a dispensing opening;

a manifold having a first orifice in fluid communication with the first flow path and a second orifice in fluid communication with the second flow path, the manifold being disposed within the dispensing opening;

an actuator assembly comprising a selector and actuator, that is coupled to the selector, the actuator assembly being movable between: (a) a first position in which only the first displaceable plunger of the first pump mechanism is actuated by the actuator for discharging only the first fluid through the first orifice of the manifold by causing the first fluid to flow along the first flow path; and (b) a second position in which only the second displaceable plunger of the second pump mechanism is actuated by the actuator for discharging only the second fluid through the second orifice of the manifold by causing the second fluid to flow along the second flow path, wherein the actuator assembly is both rotatable to select one of the first pump mechanism and the second pump mechanism and is displaceable in an axial direction to generate a pumping action; and a pump housing disposed within the closure and having a post that receives the actuator and the actuator rotates thereabout;

wherein the first flow path and the second flow path are fluidly isolated from one another along an entire length from the first reservoir to the first orifice and from the second reservoir to the second orifice, respectively;

wherein the manifold comprises a single part that receives a first conduit that defines in part the first flow path and terminates at the first orifice and a second conduit that defines in part the second flow path and terminates at the second orifice.

25. The dispenser of claim 24, wherein the selector is configured such that only one of the first pump mechanism and the second pump mechanism can be actuated at any one time.

26. The dispenser of claim 24, wherein each of the first pump mechanism and the second pump mechanism is configured to pump liquid from the first reservoir and the second reservoir, respectively.

* * * * *